US005398344A

United States Patent [19]

Hirano

[11] Patent Number: 5,398,344

[45] Date of Patent: * Mar. 21, 1995

[54] PAIR OF GLOVES

[75] Inventor: Takahiro Hirano, Sano, Japan

[73] Assignee: Hirano Seni Co., Ltd., Japan

[ * ] Notice: The portion of the term of this patent subsequent to Jul. 2, 2011 has been disclaimed.

[21] Appl. No.: 171,017

[22] Filed: Dec. 21, 1993

Related U.S. Application Data

[63] Continuation-in-part of Ser. No. 969,493, Oct. 30, 1992, Pat. No. 5,325,545.

[51] Int. Cl.[6] ..... A41D 19/00; A41D 19/01

[52] U.S. Cl. ..... 2/159; 2/160; 2/162; 2/158; 446/26

[58] Field of Search ..... 2/22, 23, 24, 158, 159, 2/160, 161.1, 161.2, 161.3, 161.4, 161.5, 161.6, 161.7, 161.8, 164, 165, 166, 167, 169, 239, 409; 446/26, 27, 28, 268, 390, 368, 369

[56] References Cited

U.S. PATENT DOCUMENTS

| | | | |
|---|---|---|---|
| 2,729,023 | 12/1953 | Lerner et al. | 2/158 X |
| 3,003,154 | 10/1961 | Litman . | |
| 3,017,640 | 1/1962 | Cardwell et al. . | |
| 3,023,420 | 3/1962 | Tann . | |
| 4,005,494 | 2/1977 | Burn . | |
| 4,295,647 | 10/1981 | Daly . | |
| 4,961,235 | 10/1990 | Williger . | |
| 4,980,929 | 1/1991 | Long | 2/158 X |
| 5,133,091 | 7/1992 | de Valle Mas . | |

FOREIGN PATENT DOCUMENTS

| | | | |
|---|---|---|---|
| 2363292 | 3/1978 | France . | |
| 537903 | 5/1993 | Japan . | |
| 3011677 | 6/1993 | WIPO | 2/160 |

*Primary Examiner*—Jeanette E. Chapman
*Attorney, Agent, or Firm*—Basile & Hanlon

[57] ABSTRACT

A pair of bags are provided on a front side upper portion of a glove main body of each of a pair of gloves so that the bags are aligned traversely on each glove. The bags are knitted goods similar to the glove main body, and the inside of the bags is in communication with the inside of the glove main body.

2 Claims, 6 Drawing Sheets

PAIR OF GLOVES

This application is a continuation-in-part application of U.S. patent application Ser. No. 07/969,493, filed Oct. 30, 1992, now U.S. Pat. No. 5,325,545, in the name of Takahiro HIRANO, the present applicant, and entitled "A PAIR OF SOCKS".

BACKGROUND OF THE INVENTION

1. Field of the Invention

The present invention relates to a knitted article such as a pair of gloves, and in particular, to a knitted article simulated to a face of an animal to attract interest of infants or children.

2. Description of the Prior Art

A pair of gloves are known in the art in which a face of an animal is drawn, or a piece of cloth having a shape of a face of an animal is sewed to each of the gloves and so that the gloves are simulated to the face of the animal.

Such gloves perform an inherent function as gloves, and at the same time, they perform a function of attracting interest of children, and they are suitable for toys of infants or children.

However, in the prior art gloves, since a face of an animal is drawn as a decorative pattern, or a piece of cloth having a shape of a face of an animal is merely sewed to the gloves, they lack the feeling of a solid or three-dimensional body, and the interest of children is not so strong.

In order to solve such a problem, the applicant proposed (Japanese Utility Model Laid-Open Publication No. Hei 5-37,903) a technique to form an ear of an animal which is more solid or three-dimensional.

However, even in this technique, it is difficult to shape an ear having a wider end portin than a base portion of the ear.

SUMMARY OF THE INVENTION

The present invention was made in view of the problems in the prior art, and it is an object of the invention to provide a pair of gloves which are simulated to a face of an animal having ears of wider end portion than a base portion.

In a pair of gloves in the present invention a pair of bags communicated with the inside of a main body are knitted integral with the main body, and an elastic string is included in an opening portion of each of the bags so that a diameter of the opening portion is constricted. Furthermore, the inside of each of the bags is filled with a stuffing.

In one aspect of the invention, since the pair of bags are knitted goods similar to the glove main body, they can be stretched or expanded relatively at will, and also, since they are bags., it is possible to stuff the inside of the gags with stuffings of a desired shape. Accordingly, when the pair of bags are stuffed with circular stuffings, ears of a circular shape (for example, ears of an elephant or a mouse) can be formed, and when stuffed with elliptical stuffings, ears of the elliptical shape (for example, ears of a rabbit or a donkey) can be formed, and when stuffed with triangular stuffings, ears of a triangular shape, for example, ears of a cat or a dog) can be formed.

Furthermore, since the opening portion of each bag is constricted by an elastic string, each bag can be shaped to have a wider end portion than its base portion similar to a circular shape.

Moreover, although the pair if bags are in communication with the inside of the main body of each of the gloves, the stuffings located in the inside of the bags will never fall off the bags only when a person wears the socks.

Furthermore, even when the knitting of the bags are expanded by the stuffings so that the stuffings can be seen through the knittings, if the stuffings of the same color as the bags are used, the external appearance of the article will not be objectionable.

DESCRIPTION OF THE PREFERRED EMBODIMENTS

Figure 1:
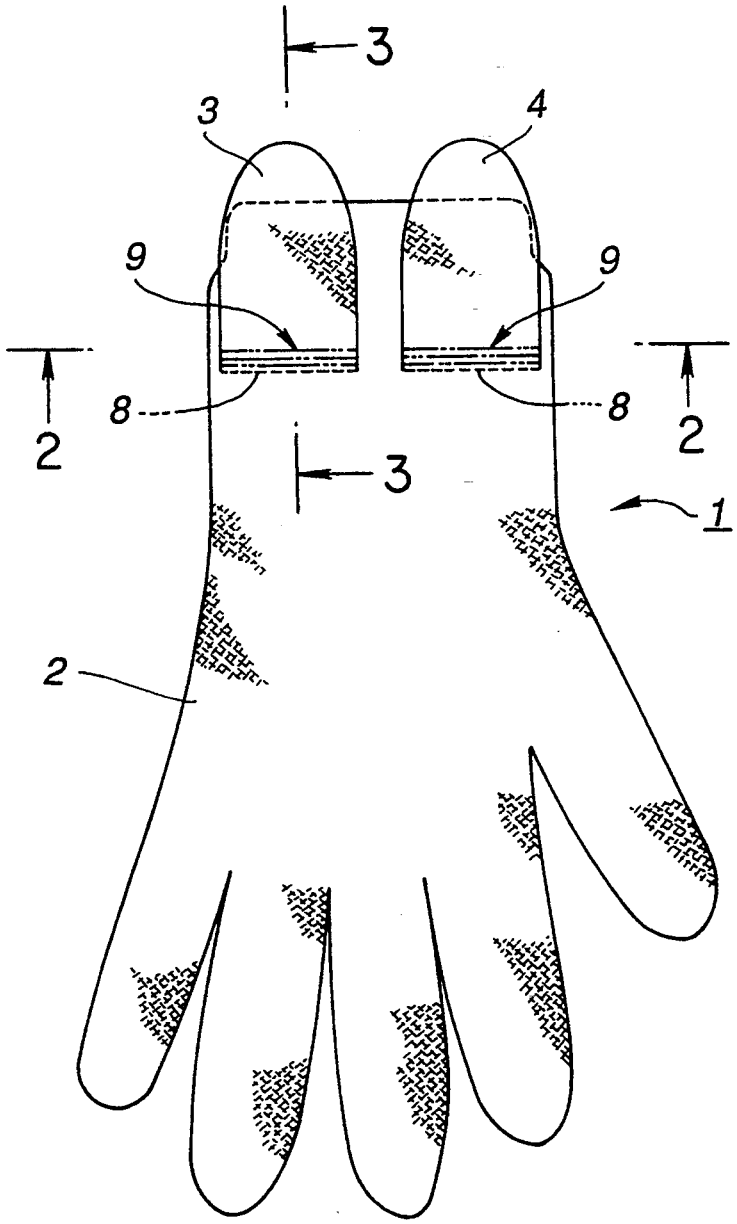
FIG. 1 is a front view of one of a pair of gloves in a first embodiment of the present invention.
Figure 2:
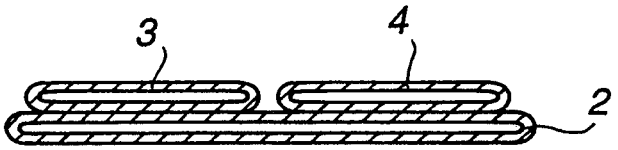
FIG. 2 is a cross sectional view taken along the line 2—2 in FIG. 1.
Figure 3:
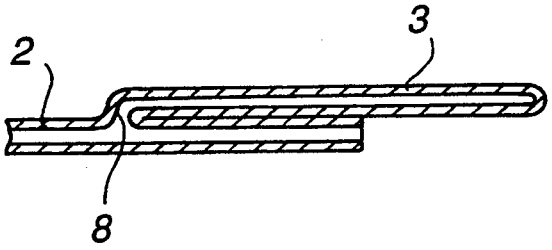
FIG. 3 is a cross sectional view taken along the line 3—3 in FIG. 1.

With reference to FIGS. 1 to 3, one of a pair of gloves 1 is composed of a glove main body 2, and a pair of bags 3 and 4 aligned traversely on a front side upper portion of the glove main boby 2. The glove main body 2 has an equivalent shape to that of a conventional glove, and therefore, when the glove main body 2 is put on a hand, the glove main body 2 performs an inherent function of covering the hand.

On the other hand, each of the pair of bags 3 and 4 is formed in a flat bag shape in most part of the length of the bag from a base portion at which the bag is connected to the glove main body 2, and a width is narrowed gradually towards a tip end. The inside of-the bag is in communication with only the inside of the glove main body 2.

The glove main body 2 as well as the bags 3 and 4 are knitted goods, and by knitting the bags 3 and 4 successibly at the time of knitting the glove main body 2, or by attaching separately knitted bags 3 and 4 to the glove main body 2, the bags 3 and 4 and the glove main body 2 are formed integrally or unitary as knitted goods.

At an opening portion 8 of each of the bags 3 and 4, at which the bag is communicated with the inside of the main body 2, an elastic string such as a rubber string 9 is included by knitting together with the bag or by attaching to the inside of the bag so that the rubber string 9 constricts a diameter of the opening portion 8. For example, the rubber string 9 may be tied to a warp of every several warps so that the rubber string 9 extends along the circumference of the opening portion 8.

Figure 4:
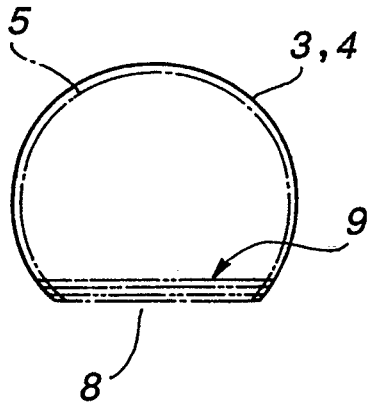
FIG. 4 is a cross sectional view of a bag portion stuffed with circular stuffing.

Since the bags 3 and 4 are knitted goods, they can be stretched relatively freely to change the shape, and thus, for example, as shown in FIG. 4, when circular stuffing 5 is stuffed in the inside of the bag 3 or 4, the bag 3 or 4 becomes circular to match the shape of the stuffing 5.

Furthermore, although the bags 3 and 4 are expanded circularly by stuffing the circular stuffing 5, since the opening portion 8 is restricted by the elasticity of the rubber string 9 to expand exceeding a predetermined size of the diameter, a fine ear of the circular shape can be formed.

Moreover, since the rubber string 9 limits the expansion of the opening portion 8 as mentioned above, even when the glove is not worn, the falling out of the stuffing 5 can be prevented.

As a result, since the circular bags 3 and 4 are aligned on the front side upper portion of the glove 1, circular ears of an animal are formed, for example, when the bags 3 and 4 are turned downwardly, ears of an elephant will be shaped, and when the bags 3 and 4 are turned upwardly, ears of a mouse will be shaped.

In this respect, when it is desired to shape the circular ears as shown in FIG. 4, an original shape of the bag having the same width continuously extending from its base to near the tip end will be suitable to form a finer circular shape, instead of the original shape of the bag having the width which is narrowed towards the tip end from the base portion.

Figure 5:
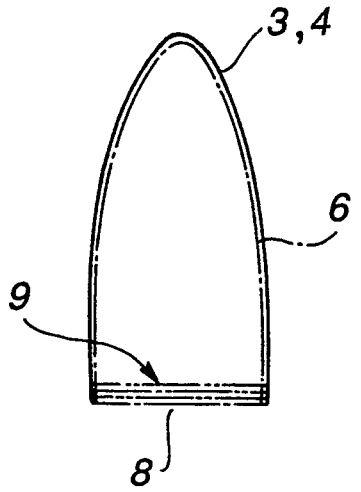
FIG. 5 is a cross sectional view of a bag portion stuffed with elliptic stuffing.

Furthermore, as shown in FIG. 5, when an elongate elliptic stuffing 6 is stuffed in the inside of the bags 3 and 4, ears of an animal having an elongate shape, for example, ears of a rabbit, or ears of a donkey will be formed by the bags 3 and 4.

Accordingly, in the glove 1 in this embodiment, since the bags 3 and 4 are integral with the glove main body 2 as knitted goods, ear of various shapes can be formed by only changing the shape of the stuffings which are stuffed into the inside of the bags 3 and 4.

Furthermore, if the color of the stuffings 5 is the same as that of the yarn used in knitting the bags 3 and 4, there will be no particular invonvenience even when the stuffings 5 are seen from the outside through the bags 3 and 4.

Moreover, in the case of the ears formed by the bags 3 and 4, since the ears mentioned above differ from ears formed by applique or the like having substantially no thickness, the above-mentioned ears are three-dimensional, and they move as if the actual ears swing as a person wearing the socks walks. Accordingly, an advantage is offered in that the interest for the gloves is increased.

Since the bags 3 and 4 are in communication with the inside of the glove main body 2, the stuffings 5 to 6 stuffed into the inside of the bags 3 and 4 will never fall off when the glove 1 is worn by a person.

Furthermore, since the bags 3 and 4 may be stuffed with other materials than the stuffings 5 to 6 mentioned above, for example, when coins are stuffed into the bags 3 and 4 to form circular ears, the glove will be utilized as a purse or pocket.

Furthermore, in addition to the formed ears as mentioned above, when a face of an animal is formed by drawing a pattern on the glove main body 2 with yarn of a different color, or by sewing a piece of cloth or button, or by forming protrudings and recesses at the time of knitting the glove main body 2, the interest will be further increased. Moreover, if a pattern representing a hole of the ear is drwan on the surface of each of the bags 3 and 4, the bags 3 and 4 will be more look like the ears.

Figure 6:
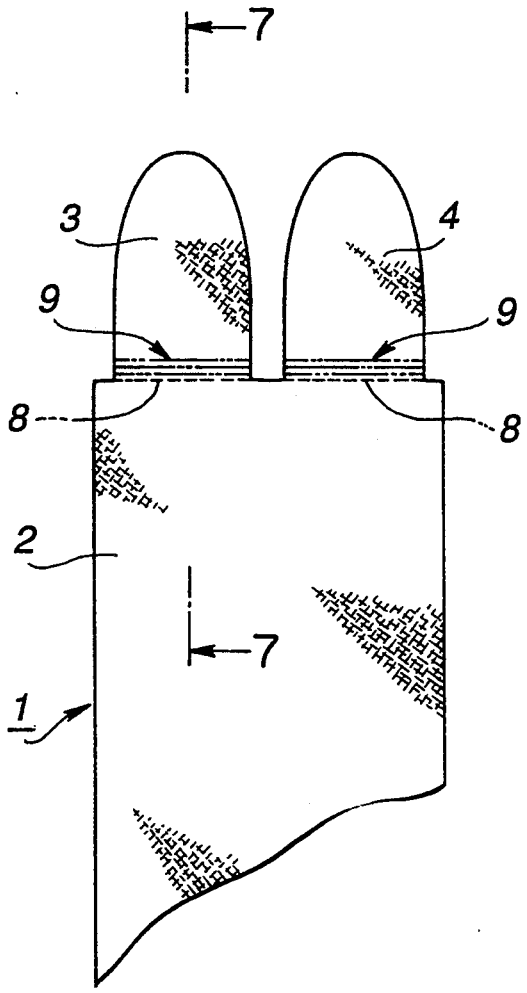
FIG. 6 is a partial front view of one of a pair of gloves in a second embodiment of the present invention.
Figure 7:
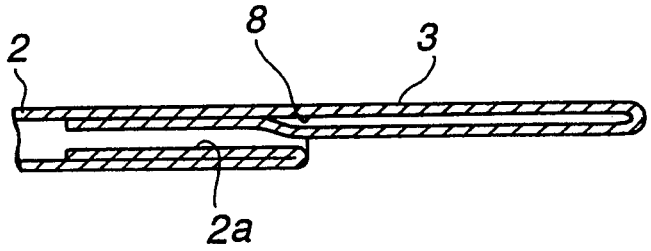
FIG. 7 is a cross sectional view taken along the line 7—7 in FIG. 6.

FIGS. 6 and 7 illustrate a second embodiment of the present invention.

In this embodiment, an upper portion 2a of a glove main body 2 is folded to the inside so that bags 3 and 4 are formed to extend upwardly from an upper end of the sock main body 2.

Figure 8:
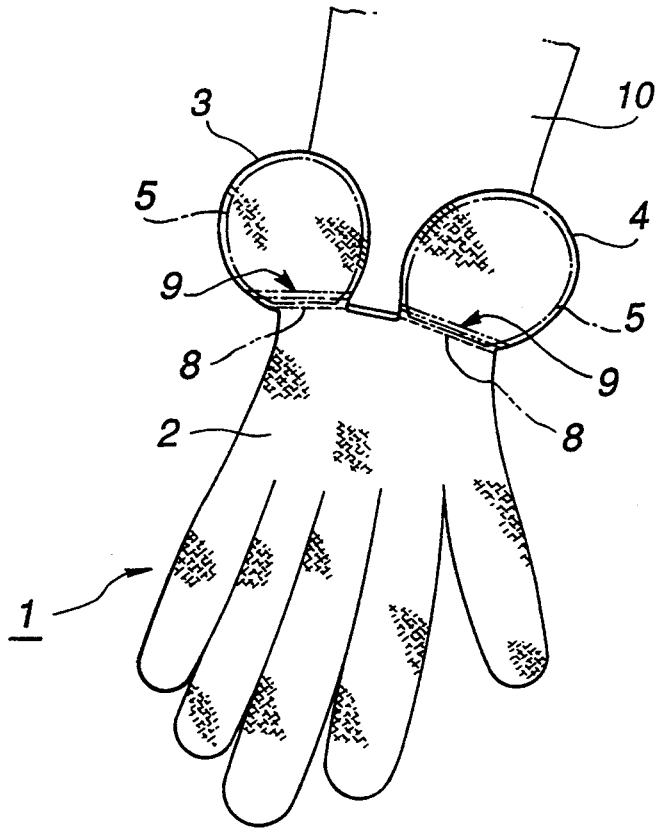
FIG. 8 is a perspective view of the gloves put on a hand.

In such a structure, when a glove 1 is put on a hand 10, as shown in FIG. 8, the ears formed by the bags 3 and 4 are aligned not on the front face but on the upper end of the glove As a result, the three-dimensional appearance is further enhanced, and the interest is increased.

Furthermore, when the upper portion 2*a* which is folded to the inside of the glove main body 2 is sewed to the glove main body 2 after stuffings 5 are stuffed into the bags 3 and 4, there is an advantage in that the stuffings 5 are prevented from falling off. However, in this sewing of the upper portion 2*a* to the glove main body 2, it is necessary to pay attention that the expansion of the opening of the glove main body 2 is disturbed.

In the first and second embodiments, it is described as to the case in which the pair of bags 3 and 4 are formed so that they are aligned traversely at the front side upper portion of the glove main body 2, however, the bags 3 and 4 may be formed at left and right lateral sides of the glove main body 2, because the bags 3 and 4 will look like ears if only the pair of bags 3 and 4 are aligned at left and right on the upper portion of the glove main body 2.

Figure 9:
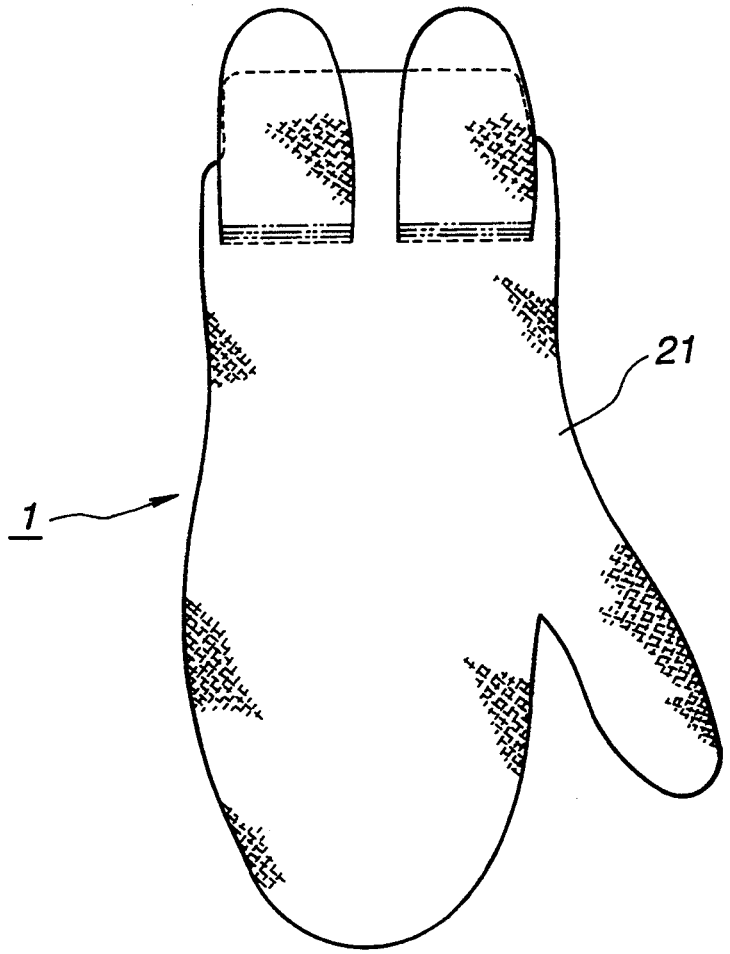
FIG. 9 is a front view of one of a pair of gloves in a third embodiment of the present invention.

FIG. 9 illustrates a glove of a third embodiment of the present invention in which only the shape of the glove main body 21 differs from that in the second and third embodiments shown respectively in FIGS. 1 and 6. Specifically, the main body 21 is branched into two parts at an end portion to form a small branch for a thumb and a large branch for the rest of the fingers.

As described in the foregoing, in the present invention, the following advantages are provided.

Since a pair of bags are knitted integrally with a glove main body of each of gloves so that the bags are aligned traversely on an upper portion of the glove main body and the inside of the bags is in communication with the inside of the glove main body, ears of various shapes can be formed by the bags. Furthermore, since the ears formed by the pair of bags are three-demensional as compared with ears formed by applique or the like, and since the bags move as if the ears swing as a person wearing the gloves moves hands, the interest is increased.

Furthermore, ears of various shapes can be made easily, and also circular ears having a wider width at the end portion than that of the base portion can be formed finely.

What is claimed is:

1. A pair of gloves comprising:

each of the gloves including a glove main body for covering a hand; and a pair of bags knitted integrally with and continuously to the main body of each of the gloves, the bags being aligned traversely on an upper portion of the glove main body and extending upright from respective opening portions located at base portions of the bags, an inside of the bags being in communication with an inside of the glove main body at the respective opening portions of the bags;

stuffing simulating the shape of the ears of an animal inserted into the inside of the bags; and means for constricting a diameter of the opening portions of the bags after the stuffing has been inserted into the inside of the bags to prevent the stuffing from falling out of the bags, wherein the bags, when filled with the stuffing and the opening portions thereof are constricted, forming the simulated ears of an animal.

2. The pair of gloves according to claim 1 wherein the constricting means comprises an elastic string disposed around the opening portion of each of the pair of bags to constrict the diameter of the opening portion.

* * * * *

UNITED STATES PATENT AND TRADEMARK OFFICE

CERTIFICATE OF CORRECTION

PATENT NO. : 5,398,344

DATED : March 21, 1995

INVENTOR(S) : Takahiro Hirano

It is certified that error appears in the above-indentified patent and that said Letters Patent is hereby corrected as shown below:

Columns 1 - 6 should be deleted and substituted with the attached sheets.

**On the title page, item [*] should read— The portion of the term of this patent subsequent to July 5, 2011 has been disclaimed.**

Signed and Sealed this

Twenty-eighth Day of November 1995

*Attest:*

Bruce Lehman

BRUCE LEHMAN

*Attesting Officer*

*Commissioner of Patents and Trademarks*

EST AVAILABLE COPY

PAIR OF GLOVES

This application is a continuation-in-part application of U.S. patent application Ser. No. 07/969,493, filed Oct. 30, 1992, now U.S. Pat. No. 5,325,545, in the name of Takahiro HIRANO, the present applicant, and entitled "A PAIR OF SOCKS".

BACKGROUND OF THE INVENTION 1. Field of the Invention

The present invention relates to a knitted article such as a pair of gloves and, in particular, to a knitted article which simulates the face of an animal to attract the interest of infants or children. 2. Description of the Prior Art A pair of gloves are known in the art in which a face of an animal is drawn, or a piece of cloth having a shape of a face of an animal is sewed to each of the gloves and so that the gloves simulate the face of the animal.

Such gloves perform an inherent function as gloves, and at the same time, they perform a function of attracting the interest of children, and they are suitable for toys of infants or children.

However, in the prior art gloves, since a face of an animal is drawn as a decorative pattern, or a piece of cloth having a shape of a face of an animal is merely sewed to the gloves, they lack the feeling of a solid or three-dimensional body, and the interest of children is not as strong.

In order to solve such a problem, the applicant proposed (Japanese Utility Model Laid-Open Publication No. Hei 5-37,903) a technique to form an ear of an animal which is more solid or three-dimensional.

However, even in this technique, it is difficult to shape an ear having a wider end portion than a base portion of the ear.

SUMMARY OF THE INVENTION

The present invention was made in view of the problems in the prior art, and it is an object of the invention to provide a pair of gloves which simulate the face of an animal having ears of wider end portion than a base portion.

In a pair of gloves in the present invention a pair of bags communicated with the inside of a main body are knitted integral with the main body, and an elastic string is included in an opening portion of each of the bags so that a diameter of the opening portion is constricted. Furthermore, the inside of each of the bags is filled with a stuffing.

In one aspect of the invention, since the pair of bags are knitted goods similar to the glove main body, they can be stretched or expanded relatively at will and, also, since they are bags, it is possible to stuff the inside of the bags with stuffing of a desired shape. Accordingly, when the pair of bags are stuffed with circular shaped stuffing, ears of a circular shape (for example, ears of an elephant or a mouse) can be formed, and when stuffed with elliptical stuffing, ears of the elliptical shape (for example, ears of a rabbit or a donkey) can be formed, and when stuffed with triangular stuffing, ears of a triangular shape, (for example, ears of a cat or a dog) can be formed.

Furthermore, since the opening portion of each bag is constricted by an elastic string, each bag can be shaped to have a wider end portion than its base portion similar to a circular shape.

Moreover, although the pair of bags are in communication with the inside of the main body of each of the gloves, the stuffing located in the inside of the bags will never fall out of the bags when a person wears the gloves.

Furthermore, even when the knitting of the bags are expanded by the stuffing so that the stuffing can be seen through the knittings, if the stuffing of the same color as the bags is used, the external appearance of the article will not be objectionable.

BRIEF DESCRIPTION OF THE DRAWINGS

FIG. 1 is a front elevational view of one of a pair of gloves in a first embodiment of the present invention;

FIG. 2 is a cross sectional view taken along the line 2—2 in FIG. 1;

FIG. 3 is a cross sectional view taken along the line 3—3 in FIG. 1;

FIG. 4 is a cross sectional view of a bag portion stuffed with circular stuffing;

FIG. 5 is a cross sectional view of a bag portion stuffed with elliptic stuffing;

FIG. 6 is a partial front view of one of a pair of gloves in a second embodiment of the present invention;

FIG. 7 is a cross sectional view taken along the line 7—7 in FIG. 6;

FIG. 8 is a perspective view of one of the gloves put on a hand; and

FIG. 9 is a front elevational view of one of a pair of gloves in a third embodiment of the present invention.

DESCRIPTION OF THE PREFERRED EMBODIMENTS

With reference to FIGS. 1 to 3, one of a pair of gloves 1 is composed of a glove main body 2 and a pair of bags 3 and 4 aligned traversely on a front side upper portion of the glove main booby 2. The glove main body 2 has an equivalent shape to that of a conventional glove, and therefore, when the glove main body 2 is put on a hand, the glove main body 2 performs an inherent function of covering the hand.

On the other hand, each of the pair of bags 3 and 4 is formed in a flat bag shape for most of the length of the bag from a base portion at which the bag is connected to the glove main body 2 and a width which is narrowed gradually towards a tip end. The inside of the bag is in communication with only the inside of the glove main body 2.

The glove main body 2 as well as the bags 3 and 4 are knitted goods, and by knitting the bags 3 and 4 successively at the time of knitting the glove main body 2, or by attaching separately knitted bags 3 and 4 to the glove main body 2, the bags 3 and 4 and the glove main body 2 are formed integrally or unitarily as knitted goods.

At an opening portion 8 of each of the bags 3 and 4, at which the bag 3 and 4 is communicated with the inside of the main body 2, an elastic string, such as a rubber string 9, is included by knitting together with the bag 3 and 4 or by attaching the string 9 to the inside of the bag 3 and 4 so that the rubber string 9 constricts a diameter of the opening portion 8 of the bag 3 and 4. For example, the rubber string 9 may be tied to a warp of every several warps so that the rubber string 9 extends along the circumference of the opening portion 8.

Since the bags 3 and 4 are knitted goods, they can be stretched relatively freely to change the shape, and thus, for example, as shown in FIG. 4, when circular stuffing 5 is stuffed in the inside of the bag 3 or 4, the

EST AVAILABLE COPY bag 3 or 4 becomes circular to match the shape of the stuffing 5.

Furthermore, although the bags 3 and 4 are expanded circularly by the circular stuffing 5, since the opening portion 8 is restricted by the elasticity of the rubber string 9 to so as to be able to expand only to a predetermined diameter, a fine ear of circular shape can be formed.

Moreover, since the rubber string 9 limits the expansion of the opening portion 8 as mentioned above, even when the glove 2 is not worn, falling out of the stuffing 5 can be prevented.

As a result, since the circular bags 3 and 4 are aligned on the front side upper portion of the glove 1, circular ears of an animal are formed. For example, when the bags 3 and 4 are turned downwardly, ears of an elephant will be shaped, and when the bags 3 and 4 are turned upwardly, ears of a mouse will be shaped.

In this respect, when it is desired to shape the circular ears as shown in FIG. 4, an original shape of the bag having the same width continuously extending from its base to near the tip end will be suitable to form a fine circular shape, instead of the original shape of the bag having the width which narrows towards the tip end from the base portion.

Furthermore, as shown in FIG. 5, when an elongate elliptic stuffing 6 is stuffed in the inside of the bags 3 and 4, ears of an animal having an elongate shape, for example, ears of a rabbit, or ears of a donkey will be formed by the bags 3 and 4.

Accordingly, in the glove 1 in this embodiment, since the bags 3 and 4 are integral with the glove main body 2 as knitted goods, ear of various shapes can be formed by only changing the shape of the stuffing which is stuffed into the inside of the bags 3 and 4.

Furthermore, if the color of the stuffing 5 is the same as that of the yarn used in knitting the bags 3 and 4, there will be no particular inconvenience even when the stuffing 5 is seen from the outside through the bags 3 and 4.

Moreover, in the case of the ears formed by the bags 3 and 4, since the ears mentioned above differ from ears formed by an applique or the like having substantially no thickness, the above-mentioned ears are three-dimensional, and they move as actual ears swing when a person wearing the gloves walks. Accordingly, an advantage is offered in that the interest for the gloves is increased.

Since the bags 3 and 4 are in communication with the inside of the glove main body 2, the stuffing 5 or 6 stuffed into the inside of the bags 3 and 4 will never fall out when the glove 1 is worn by a person.

Furthermore, since the bags 3 and 4 may be stuffed with other materials than the stuffing 5 or 6 mentioned above, for example, when coins are stuffed into the bags 3 and 4 to form circular ears, the glove can be utilized as a purse or pocket.

Furthermore, in addition to the formed ears as mentioned above, when a face of an animal is formed by drawing a pattern on the glove main body 2 with yarn of different color, or by sewing a piece of cloth or button, or by forming protrusions and recesses at the time of knitting the glove main body 2, the interest in the glove will be further increased. Moreover, if a pattern representing a hole of the ear is drawn on the surface of each of the bags 3 and 4, the bags 3 and 4 will look more like actual ears.

FIGS. 6 and 7 illustrate a second embodiment of the present invention.

In this embodiment, an upper portion 2*a*, shown only in FIG. 7, of a glove main body 2 is folded to the inside so that bags 3 and 4 are formed to extend upwardly from an upper end of the glove main body 2.

In such a structure, when a glove 1 is put on a hand 10, as shown in FIG. 8, the ears formed by the bags 3 and 4 are aligned not on the front face but on the upper end of the glove 1. As a result, the three-dimensional appearance of the ears formed by the bags 3 and 4 is further enhanced and interest in the gloves is increased.

Furthermore, when the upper portion 2*a* which is folded to the inside of the glove main body 2 is sewed to the glove main body 2 after the stuffing 5 is stuffed into the bags 3 and 4, there is an advantage in that the stuffing 5 is prevented from falling out of the bags 3 and 4. However, in this sewing of the upper portion 2*a* to the glove main body 2, it is necessary to pay attention that the expansion of the opening of the glove main body 2 is not disturbed.

In the first and second embodiments, it is described as to the case in which the pair of bags 3 and 4 are formed so that they are aligned traversely at the front side upper portion of the glove main body 2. However, the bags 3 and 4 may be formed at left and right lateral sides of the glove main body 2, because the bags 3 and 4 will still look like ears if only the pair of bags 3 and 4 are aligned at left and right sides on the upper portion of the glove main body 2.

FIG. 9 illustrates a glove of a third embodiment of the present invention in which only the shape of the glove main body 21 differs from that in the second and third embodiments shown respectively in FIGS. 1 and 6. Specifically, the main body 21 is branched into two parts at an end portion to form a small branch for a thumb and a large branch for the rest of the fingers.

As described in the foregoing, in the present invention, the following advantages are provided.

Since a pair of bags are knitted integrally with a glove main body of each of gloves so that the bags are aligned traversely on an upper portion of the glove main body and the inside of the bags is in communication with the inside of the glove main body, ears of various shapes can be formed by the bags. Furthermore, since the ears formed by the pair of bags are three-demensional as compared with ears formed by an applique or the like, and since the bags move in the same manner as actual ears swing when a person wearing the gloves moves his or her hands, the interest is increased.

Furthermore, ears of various shapes can be made easily, and also circular ears having a wider width at the end portion than that of the base portion can be formed.

What is claimed is:

1. A pair of gloves comprising:

each of the gloves including a glove main body for covering a hand; and a pair of bags knitted integrally with and continuously to the glove main body of each of the gloves, the bags being aligned traversely on an upper portion of the glove main body and extending upright from respective opening portions located at base portions of the bags, an inside of the bags being in communication with an inside of the glove main body at the respective opening portions of the bags;

stuffing simulating the shape of the ears of an animal inserted into the inside of the bags; and

EST AVAILABLE COPY means for constricting a diameter of the opening portions of the bags after the stuffings have been inserted into the inside of the bags to prevent the stuffings from falling out of the bags, wherein the bags, when filled with the stuffings and the opening portions thereof are constricted, forming the simulated ears of an animal.

2. The pair of gloves according to claim 1 wherein the constricting means comprises an elastic string disposed around the opening portion of each of the pair of bags to constrict the diameter of the opening portion.

* * * * *